United States Patent [19]

Murray

[11] 3,933,106

[45] Jan. 20, 1976

[54] PRESSER DEVICE FOR OVEREDGE SEWING MACHINES

[75] Inventor: Ian S. Murray, Harestanes Kirkintilloch, Scotland

[73] Assignee: The Singer Company, New York, N.Y.

[22] Filed: Oct. 31, 1974

[21] Appl. No.: 519,461

[52] U.S. Cl. ..... 112/235

[51] Int. Cl.[2] ..... D05B 29/02

[58] Field of Search ..... 112/235, 236, 237, 240

[56] References Cited

UNITED STATES PATENTS

| | | | |
|---|---|---|---|
| 2,157,372 | 5/1939 | Weis | 112/235 |
| 3,044,428 | 7/1962 | Hale et al. | 112/235 |

*Primary Examiner*—Werner H. Schroeder
*Assistant Examiner*—Peter Nerbun
*Attorney, Agent, or Firm*—Marshall J. Breen; Edward L. Bell; Robert E. Smith

[57] ABSTRACT

A low inertia presser device for overedge sewing machine. A horizontally disposed presser bar arm and a similarly disposed presser bar arm leaf spring are mutually pivoted at one end on substantially horizontal and vertical pivots to permit vertical movement and swing out capability. A main pressure spring acts on the presser bar arm; which in turn, through an arm extension to the presser bar arm approximately midway its pivoted end and the point of action of the main spring, applies pressure approximately midway along the presser bar arm leaf spring. A presser foot is supported on the end of the leaf spring opposite its pivoted end.

2 Claims, 5 Drawing Figures

PRESSER DEVICE FOR OVEREDGE SEWING MACHINES

BACKGROUND OF THE INVENTION

The invention relates to a low inertia presser device specifically intended for an overedge sewing machine wherein the presser device may be swung out of the way for better access to the sewing instrumentalities. Such a swing-away presser device is disclosed in the U.S. Pat. No. 2,419,494, Apr. 22, 1947, to N. Knaus, which discloses a presser device pivoted on horizontal and vertical pivots to permit the presser device to be elevated to insert work fabric or elevated and swung out of the way, for example, to thread the sewing needle. As is typical in overedge sewing machines, a horizontally disposed presser device is used which is less sensitive to inertia effect in that the entire mass of the device is not equally effected. However, with the increase in speed capability of overedge machines, due to better manufacture and more sophisticated design, coupled with the increased popularity of synthetic fabrics and knits, which are more susceptible to pucker due to increased presser bar pressure, low inertia presser devices have become more desirable in overedge sewing machines as they have in other types of industrial sewing machines. It is most desirable that this end be achieved in an overedge sewing machine without design compromise.

Summary of the Invention

The above desired end is achieved in this invention by utilizing an elongate presser bar arm leaf spring to support the presser foot, the leaf spring and presser bar arm being coupled at one end to pivot on horizontal and vertical pivots. The presser bar arm is urged, as before, by a main pressure spring towards the overedge machine bed. An arm extension to the presser bar arm, located approximately midway between the horizontal and vertical pivots and the point of application of the main pressure spring, carries an adjustment screw which impinges on the presser bar arm leaf spring approximately midway between its pivot point and the presser foot. The adjustment screw is utilized to alter the inclination of the presser bar arm leaf spring for the purpose of having the sole of the presser foot lie flat on the work material. In operation virtually all of the motion imparted to the presser foot by the feed dog of the sewing machine is accommodated by the elongate leaf spring due to its low inertia as compared to the presser bar arm and main pressure spring assembly.

BRIEF DESCRIPTION OF DRAWINGS

Having in mind the above and other objects that will be evident from an understanding of this disclosure, the invention comprises the devices, combinations and arrangements of parts as illustrated in the presently preferred embodiment of the invention which is hereinafter set forth in such detail as to enable those skilled in the art to readily understand the function, operation, construction and advantages of it when read in conjunction with the accompanying drawings in which:

In FIG. 1 is shown an overedge sewing machine 10 having a sewing needle 11 fastened to a needle carrier 12 which is supported for reciprocation, by instrumentalities not shown, on a needle carrier support bar 13. A hinged cover 15 shrouds the reciprocation mechanism. The sewing needle 11 cooperates with sewing instrumentalities (not shown) in a bed 17 of the overedge sewing machine in the formation of sewing stitches.

Figure 1:
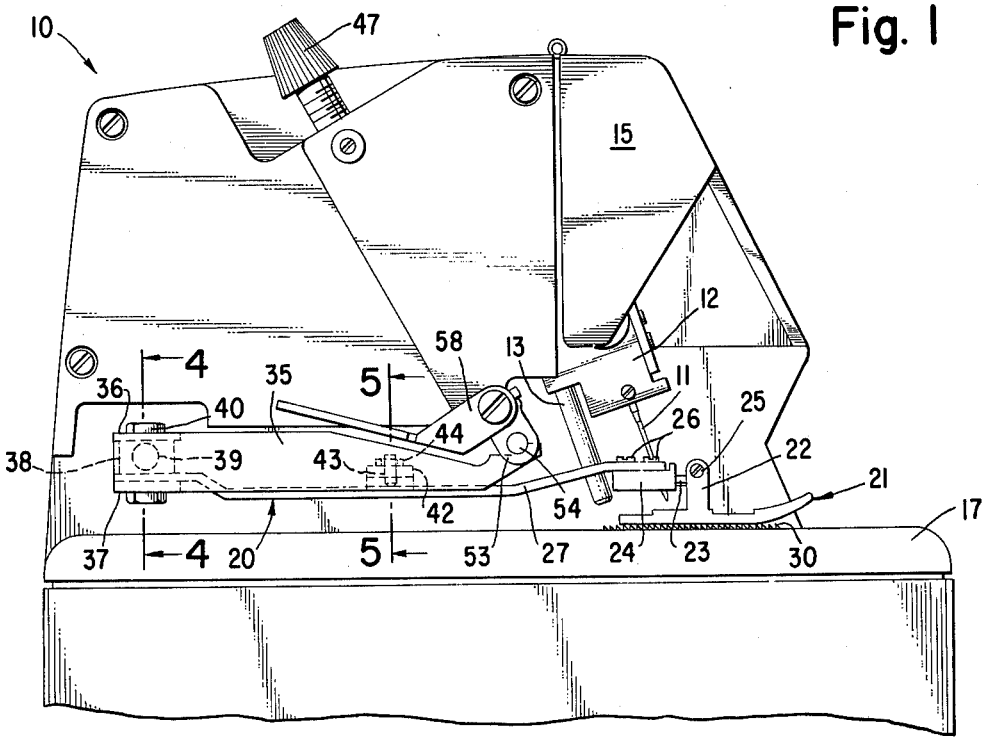
FIG. 1 is an end elevation of an overedge sewing machine showing the presser device of the invention in operative position.

Also apparent in FIG. 1 is a presser device 20 subject of this patent application. At one extremity of the presser device 20 is located a presser foot 21 adjustably attached by an integral clevis 22 to a rod 23 on the extremity of a swivel block 24. The clevis 22 is clamped to the rod 23 by a screw 25. The swivel bolck is attached by screws 26 to a presser bar arm leaf spring 27, the screws passing through clearance holes in the leaf spring. Thus the presser foot 21 may be rotated about the rod 23 to obtain sideways seating of the presser foot with the bed 17 and may be adjusted to the extent of the clearance holes in the presser bar arm leaf spring 27 to obtain alignment with feeding dogs 30 protruding through the bed 17 during a feeding cycle. The sewing needle 11 operates through a needle groove 31 in the presser foot 21.

Figure 3:
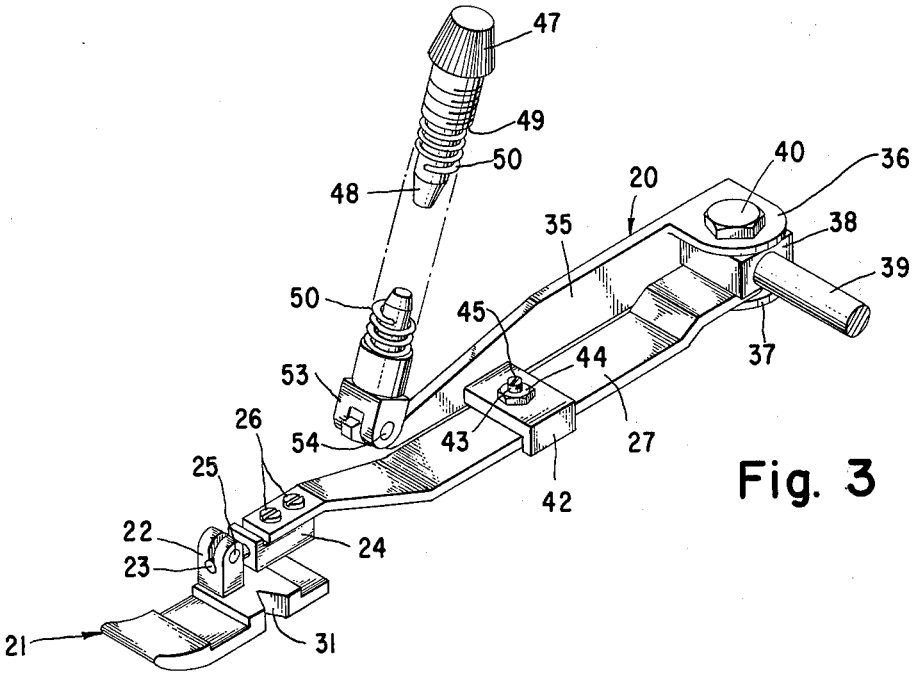
FIG. 3 is an assembled perspective view of the presser device indicating the interrelation of the various component parts.
Figure 4:
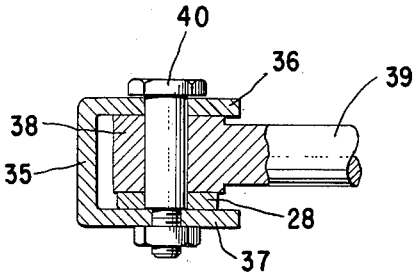
FIG. 4 is a sectional view taken substantially along the line 4—4 of FIG. 1 indicating the construction of the vertical pivot.

Referring to FIGS. 1 and 3 it will be noted that the presser bar arm leaf spring 27 is horizontally disposed adjacent a presser bar arm 35 and is joined therewith on the end of the leaf spring opposite the presser foot 21 (see FIG. 4). The presser bar arm 35 is fashioned on its rear extremity with a pair of oppositely disposed ears 36 and 37 between which is captured the rear extremity 28 of the presser bar arm leaf spring 27 and a lug extremity 38 of a rock shaft 39 having operative connection to a knee lifter (not shown). The knee lifter may be shifted to rotate the rock shaft 39 which through the lug extremity 38 will rotate the presser bar arm 35 and the presser bar arm leaf spring 27 counterclockwise as viewed in FIG. 1. Thus the rock shaft 39 forms a horizontal pivot axis for the presser device 20. A shouldered screw 40 is clamped by nut 41 to the ear 37 and retains the presser bar arm 35 and presser bar arm leaf spring 27 vertically rotatable on the lug extremity 38 of the rock shaft 39. Thus the shouldered screw 40 forms a vertical pivot for the presser device 20.

Figure 5:
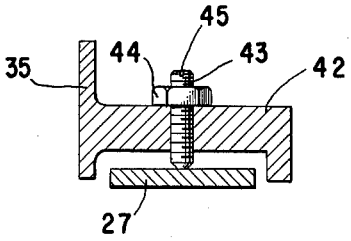
FIG. 5 is a sectional view taken substantially along the line 5—5 of FIG. 1 indicating the construction of the adjustable torque transfer point.

An arm extension 42 (see FIGS. 3 and 5) to the presser bar arm 35 extends about the presser bar arm leaf spring 27 and supports in a threaded hole an adjusting screw 43 whose position with respect to the arm extension 42 may be locked by nut 44. The end of the adjusting screw 43 impinges on the presser bar arm leaf spring 27 approximately midway its length and is adjusted by means of screwdriver slot 45 to obtain front to back seating of the presser foot 21 with work material being stitched.

Also visible in FIGS. 1 and 3 is a presser bar arm pressure adjusting screw 47 which may be threaded into screw threads in a bore (not shown) in the overedge sewing machine 10, and have a bullet nose 48 and a shoulder 49 which insert into and impinge on a pressure spring 50 also supported in the bore. A bifurcated head 53 supporting a pin 54 straddles the presser bar arm 35 and is supported in the bore (not shown) in the sewing machine 10. The pressure spring 50 presses against the head 53, which is urged by the spring to apply force on the presser bar arm 35. A pressure spring lifter 58 cooperates with an extension (not shown) to the bifurcated head 53 to lift the head 53 and pin 54 from contact with the presser bar arm 35 when the pressure spring lifter is rotated clockwise as viewed in FIG. 1.

In operation the pressure spring 50 exerts force on the extremity of the presser bar arm 35 creating a torque about rock shaft 39. This torque is transmitted by adjusting screw 43 to the presser bar arm leaf spring 27 thereby urging the presser foot 21 connected to its extremity against the work material. The rising and falling action imparted to the presser foot 21 by the feeding dogs 30 or by the action of a cross seam passing beneath the presser foot is taken up almost exclusively by flexure of the presser bar arm leaf spring 27 owing to its low inertia as compared to the inertia of the complete presser device 20 including presser bar arm 35, arm extension 42, rock shaft 39, lug extremity 38, bifurcated head 53 and pressure spring 50. The greater the force applied by the pressure spring 50, the larger the movement of the presser foot 21 which can be accommodated before the inertia effects of the above included parts of the presser device 20 affect the control of the materials being sewn.

Figure 2:
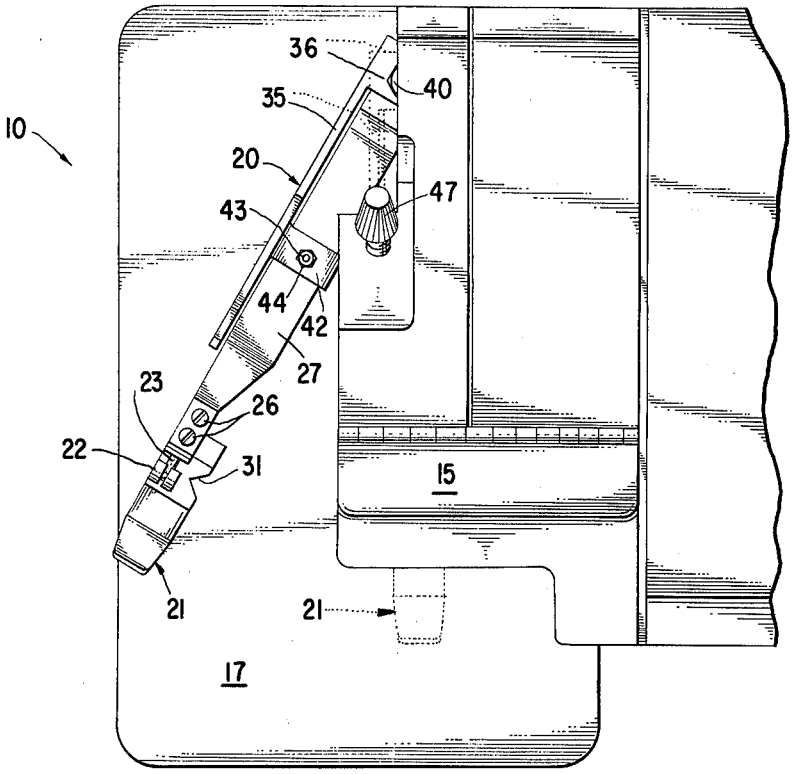
FIG. 2 is a partial view in plan of the overedge machine of FIG. 1 with the presser device shown in the swing-away position.

When required, the effects of the pressure spring 50 may be removed from the presser bar arm 35 by clockwise rotation as viewed in FIG. 1 of the pressure spring lifter 58, whereupon the presser bar arm 35 may be lifted by shift of the knee lifting device (not shown) to rotate rock shaft 39 counterclockwise as viewed in FIG. 1, and the presser bar arm and presser bar arm leaf spring 27 may be rotated about its vertical pivot from the position indicated in phantom in FIG. 2 to that shown in solid to permit ready accessibility to the sewing instrumentalities.

I claim:

1. For an overedge sewing machine having a frame, a presser device comprising:

a presser bar arm having two ends, means pivotally supporting one end of said presser bar arm relatively to said frame on substantially horizontal and vertical pivots, means on the other of said ends for receiving a force for depressing said presser bar arm, a leaf spring located substantially parallel to said presser bar arm and having two extremities, means supporting one extremity of said leaf spring together with said presser bar arm for pivotal motion therewith, a presser foot carried at the other extremity of said leaf spring, and a lateral projection formed on said presser bar arm extending over and contacting a portion of said leaf spring intermediate the leaf spring extremities.

2. For an overedge sewing machine, a presser device as claimed in claim 1 wherein said means pivotally supporting said presser bar arm together with said leaf spring for pivotal motion includes a horizontally disposed rock shaft mounted in said sewing machine frame, said rock shaft having a lug extremity with a bore therethrough vertically disposed, a pair of oppositely disposed ears extending from said pivotally supported end of said presser bar arm and embracing said lug extremity of said rock shaft and said one extremity of said leaf spring, said ears and said one extremity of said leaf spring having bores therethrough aligned with said bore in said lug extremity, a pivot pin and means retaining said pivot pin in said bores through said ears, said lug extremity and said one extremity of said leaf spring.

* * * * *